US005480474A

United States Patent [19]

Ulrich

[11] Patent Number: 5,480,474

[45] Date of Patent: Jan. 2, 1996

[54] PROCESS AND APPARATUS FOR SMELTING REDUCTION OF ORES OR PRE-REDUCED METAL CARRIERS

[75] Inventor: Kalus H. Ulrich, Heiligenhaus, Germany

[73] Assignee: Mannesmann Aktiengesellschaft, Dusseldorf, Germany

[21] Appl. No.: 260,032

[22] Filed: Jun. 15, 1994

[30] Foreign Application Priority Data

Jun. 15, 1993 [DE] Germany ..... 43 20 572.0

[51] Int. Cl.[6] ..... C21B 11/00

[52] U.S. Cl. ..... 75/502; 266/175; 266/186

[58] Field of Search ..... 75/500, 501, 502; 266/186, 175

[56] References Cited

U.S. PATENT DOCUMENTS 5,069,715 12/1991 Reid ..... 75/501

*Primary Examiner*—Melvyn Andrews

*Attorney, Agent, or Firm*—Cohen, Pontani, Lieberman, Pavane

[57] ABSTRACT

A process and apparatus for smelting reduction of ores or pre-reduced metal carriers in the form of an emulsion composed of slag, liquid metal and floating coke particles which pass from a smelting reduction reactor to a separate settling tank through a connection conduit. At least one lance is provided for blowing a "hard" stream of oxygen into the settling tank while a second lance is provided for blowing a relatively "soft" stream of oxygen into the settling tank. The relatively softly blown stream of oxygen sufficiently increases the volume of gas in the settling tank beyond that resulting from the hard oxygen stream alone so as to drive back coke particles floating on the emulsion from the settling tank to the smelting reduction reactor through the connection conduit.

9 Claims, 1 Drawing Sheet

PROCESS AND APPARATUS FOR SMELTING REDUCTION OF ORES OR PRE-REDUCED METAL CARRIERS

BACKGROUND OF THE INVENTION

1. Field of the Invention

The invention is directed to a process and apparatus for the smelting reduction of ores or pre-reduced metal carriers which arrive in a separate settling tank from a smelting reduction reactor through a connection conduit in the form of an emulsion composed of slag, liquid metal and floating coke particles and are converted in the settling tank to form pig iron with a low carbon content by blowing oxygen.

2. Discussion of the Prior Art

A process for the production of iron in which a smelting vessel is coupled with an ore reduction vessel and the reaction gases emerging from the iron melt are partially after-burned in the smelting vessel is known from EP 0 126 391 A1. For this purpose, oxygen top-blowing nozzles whose blowing direction is directed approximately to the center of the bath are arranged in an upper gas space of the smelting vessel. An afterburning is achieved by having gas jets, which act as free jets along a section of adequate length in the gas space of the smelting vessel, suck in an amount of the reaction gases from the gas space. This amount is a multiple of the volume of the oxygen introduced by the nozzles. The ore reduction vessel is connected with the smelting vessel via a discharge device and a fall line. In addition, a smelting reduction vessel, which is connected via a connection piece with a smelting furnace so that the molten substance can flow from one vessel to the other, is known from JP 62228420 (Application No. 86-70897). Oxygen top-blowing lances project into the upper pan of the smelting furnace. In the known processes and devices described above, the molten substance flows to a settling tank as an emulsion of metal, slag and coke particles.

The known processes and devices described above have the disadvantage that floating coke separated in the settling tank remains in this tank. Typically, the coke particles float near or at the surface of the emulsion in the settling tank. Consequently, this coke must be oxidized along with the other contents to achieve the aimed for reduced carbon content in the metal. As a result, the surplus coke is lost in the known processes and the corresponding oxidation heat must be negated by cooling to prevent excess temperatures. Moreover, the installed top-blowing oxygen lances do not permit thermal energy to be supplied independently to the process as would be necessary in the event of disturbances in the process to prevent congealing of a hearth of the settling tank.

SUMMARY OF INVENTION

An object of the present invention is to provide a process for smelting reduction and the requisite apparatus having a smelting reactor and a sealing tank in which the start-up of the smelting reduction device is facilitated.

It is another object of the present invention to provide a process for smelting reduction and the requisite apparatus having a smelting reactor and a settling tank in which impediments to the production of pig iron due to surplus coke are prevented in normal operation.

It is still another object of the present invention to provide a process for smelting reduction and the requisite apparatus having a smelting reactor and a settling tank in which negative consequences of operating disturbances are alleviated.

The present invention achieves these objects by providing a process and apparatus for the smelting reduction of pre-reduced metal carriers, e.g. ores, which arrive in a separate settling tank from a smelting reduction reactor through a connection conduit in the form of an emulsion composed of slag, liquid metal and floating coke particles. In the settling tank the emulsion separates into a lower layer, comprising metal, and an upper layer, comprising slag with coke floating at or about an upper surface of the upper layer. The pre-reduced metal carriers are convened in the settling tank to pig iron with a low carbon content by blowing oxygen. A "hard" jet of oxygen is blown in a generally downward direction through at least a first lance into an upper part of the sealing tank. Also, a "soft" jet of oxygen is blown in a generally downward direction through at least a second lance into the upper part of the settling tank. The soft jet increases the volume of gas in the settling tank so as to increase the volume of gas flowing from the sealing tank through the connection conduit into the smelting reduction reactor. This increased volume of gas is sufficient to drive the coke particles floating on the emulsion back to the smelting reduction reactor in a direction opposite a direction of flow of the emulsion to the settling tank.

As defined herein, the hard jet of oxygen is a stream, which is focused and has sufficient momentum to drive downwardly through the upper layer of slag and contact the metal of the lower layer. In contrast, the soft jet of oxygen is defined herein as an unfocused stream which produces a bushy flame and has insufficient momentum to penetrate significantly into the upper layer of slag and floating coke particles.

The invention also achieves these objects by providing a process and apparatus wherein a volume of an oxygen-fuel mixture to the settling tank is adjustable as a function of the desired carbon content of the metal.

The various features of novelty which characterize the invention are pointed out with particularity in the claims annexed to and forming a pan of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
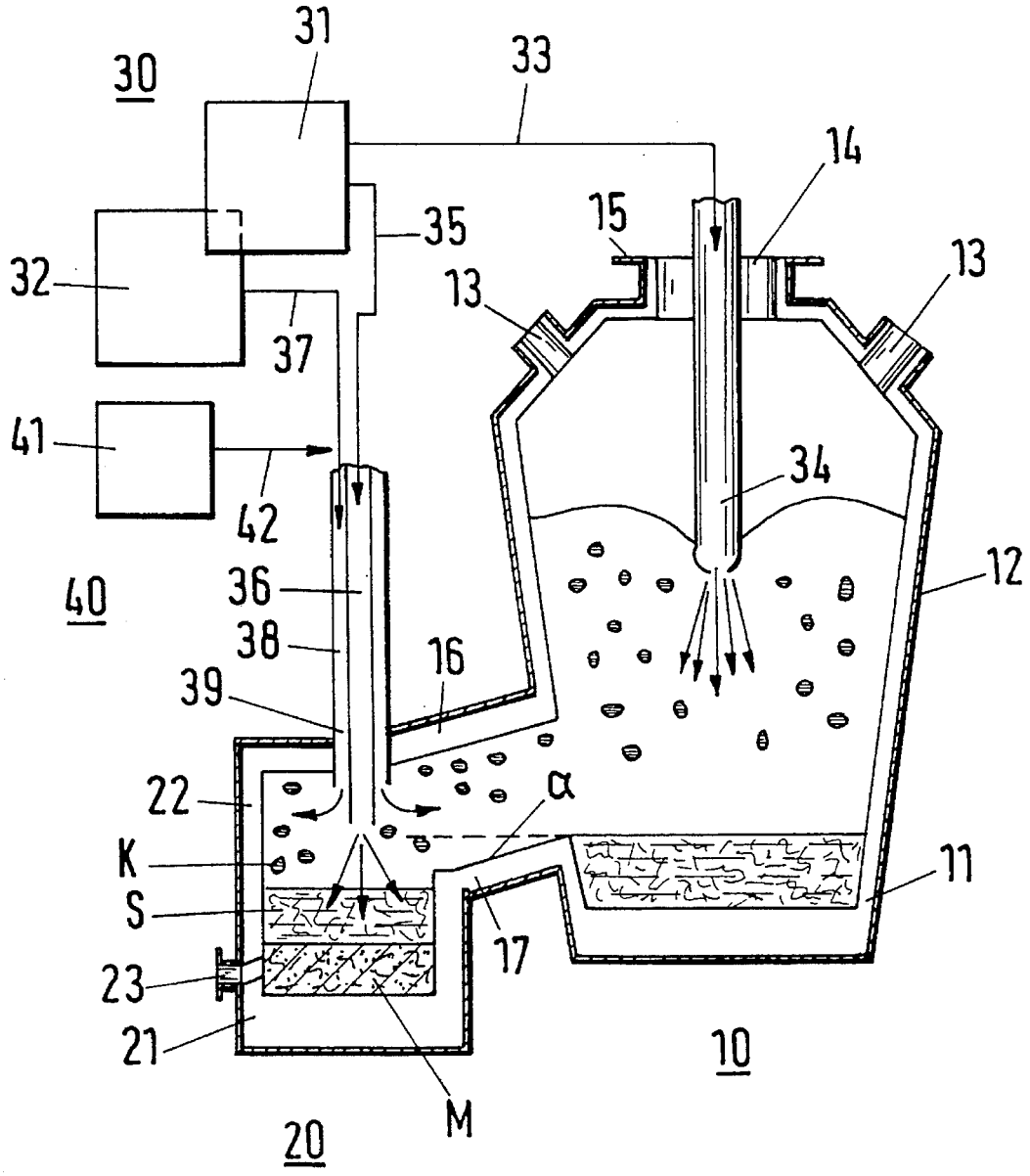
FIG. 1 shows a schematic view of an apparatus for performing a process of the present invention for smelting reduction of pre-reduced metal carriers.

Known smelting reduction processes produce emulsions of slag and metal which can include various amounts of solid carbon. The solid carbon is derived from coal (or coke) added as a reducing agent in a reaction vessel to a pre-reduced metal carrier comprising one or more pre-reduced metal oxides, e.g. pre-reduced iron ore. The metal oxide or metal oxides react with the coal in a reactor vessel to convert to the metal and slag in the emulsion of the three components, metal, slag and carbon. This conversion includes smelting the reaction components and performing an endothermal reduction reaction. The energy required for the endothermal reduction reaction and the smelting of the reaction components is provided by partial combustion of the added coal by means of pure oxygen or pre-heated air.

The metal resulting from reduction which, depending on the element in question, can have a correspondingly high solubility for carbon, is present in the form of molten drops in the slag or has also partially settled under this slag as a separate phase.

Overall smelting reduction processes aim for a high recovery or yield of the metallic product, e.g. pig iron. As a result, pig iron can be converted at a distinctly lower cost in the further processing stages if the carbon-containing pig iron is partially converted to an intermediate metal having a carbon content of 0.5 to 1.5%. Such values are achieved particularly in smelting reduction devices comprising a reactor vessel and a separate settling tank connected with the reactor vessel. In these devices, the reactor vessel is used exclusively for the smelting reduction and high specific throughput rates per volume unit which can be achieved in so doing are fully exploited. The emulsion of slag, metal and coke flows from the reactor vessel to the settling tank connected thereto and separates into three phases in the settling tank: metal, slag and floating coke particles.

The present invention provides lances which add oxygen to the settling tank in hard blasts, i.e. jets, to convert the pig iron into a primary metal with reduced carbon content. Moreover, the present invention provides a soft jet of oxygen blown into the settling tank for partial oxidation of the coke floating in the sealing tank, so as to increase the gas volume and accordingly guide the floating coke back into the smelting reduction reactor. Therefore, this floating coke need not be oxidized along with the other contents of the settling tank and accordingly need not deprive the process of the energy available from such oxidation. Moreover, as a result of guiding the floating coke back to the smelting reactor, it is not necessary to eliminate the oxidation heat by cooling to prevent excess temperatures. A connection conduit is connected to the reactor vessel and settling tank and is designed in such a way that the coke particles floating on the emulsion of slag and metal are driven into the reactor vessel, in the opposite direction to that of the emulsion flow, by means of a gas volume flow produced in a fore-hearth of the settling tank as a result of the oxidation of the coke by oxygen. In normal operation, the soft jet results in a soft, unfocused or bushy flame and adjacent to the soft unfocused or bushy flame, a central lance is located. The central lance has a nozzle which generates a hard jet of oxygen at high momentum which penetrates through the slag to the surface of the metal and oxidizes oxygen dissolved in a bath of the metal.

Further, the lance for the soft oxygen jet is used to heat the settling tank, at startup when it is empty, as well as to maintain heat in the event of disturbances in the smelting reduction device. For this purpose, a mixture of different energy carriers, e.g. fuel gas, oil or coal dust, and oxygen can also be used.

FIG. 1 shows a smelting reduction reactor vessel 10 which tapers downward slightly in a conical manner and has a lower vessel portion 11 and an upper vessel portion 12, a passage 13 for the burden, e.g. ore, fed to the reactor vessel 10 and an exhaust 14 for the waste gas produced by the reactor vessel 10. Typically, the exhaust conduit 14 feeds the waste gas to a stack or shaft (not shown). A lance 34 provided in the center of the reactor head 15 projects into the upper vessel portion 12 and is connected via a feed line 33 with an oxygen station 31 of the oxygen supply 30. A connection conduit 16 which connects the smelting reduction reactor 10 with a settling tank 20 is provided in the region of the lower vessel portion 11 of the smelting reduction reactor 10. The base 17 of the connection conduit 16 is inclined at an angle $\propto$ to the settling tank 20.

A tap 23 is provided in the lower vessel portion 21 of the settling tank 20 for tapping the molten metal M and slag S.

The lance 36 projects into the upper vessel portion 22 of the settling tank 20 and is connected, via a feed line 35, with the oxygen station 31 for the "hard blowing" of oxygen.

Also projecting into the upper vessel portion 22 is a lance 38 having, at its downstream end, an annular passage or annular gap 39 which is connected, via a feed line 37, with an oxygen station 32 for the "soft blowing" of oxygen. Further, the annular gap 39 is connected by feed line 42 to a station 41 of a fuel supply 40.

The annular gap 39 is arranged coaxially relative to the lance 36 as shown in FIG. 1.

The arrows shown in FIG. 1 indicate the direction of flow of the individual media. The oxygen jet emerges from the annular gap 39 in a soft, bushy flame and drives the coke particles K from the settling tank 20 into the smelting reduction reactor 10 via the connection conduit 16.

The invention is not limited by the embodiments described above which are presented as examples only but can be modified in various ways within the scope of protection defined by the appended patent claims.

What is claimed is:

1. A process for the smelting reduction of a pre-reduced metal carrier, wherein the metal comprises iron, to form pig iron having a low carbon content, comprising the steps of:

feeding the metal carrier and a carbon-containing substance to a smelting reduction reactor;

converting the metal carrier and carbon-containing substance in the smelting reduction reactor to an emulsion comprising slag, liquid metal and floating coke particles;

passing the emulsion from the smelting reduction reactor through a connection conduit to a separate sealing tank;

separating the emulsion in the settling tank into an upper layer comprising slag and coke particles and a lower layer comprising metal, wherein at least a portion of the coke particles comprise coke particles floating in an upper portion of the upper layer; and blowing oxygen into the settling tank to convert the liquid metal of said emulsion to pig iron, said step of blowing oxygen comprising:

blowing a first jet of a first oxygen-containing stream through a first lance into an upper pan of the settling tank, said first jet of the first oxygen-containing stream being focused and being blown with sufficient momentum for penetrating the upper layer and contacting the lower layer; and blowing a second jet of a second oxygen-containing stream through a second lance into the upper part of the settling tank so as to increase a volume of gas in the settling tank, said second jet of the second oxygen-containing stream being sufficiently unfocused so as to produce a bushy flame and being blown with a momentum less than the momentum of the first jet for at most partially penetrating the slag layer, and said increased volume of gas in the sealing tank causing a flow of gas from the settling tank to the reduction reactor through the connection conduit so as to drive the floating coke particles of the emulsion from the settling tank to the smelting reduction reactor opposite a direction of flow of the emulsion from the reduction reactor to the settling tank.

2. The process according to claim 1, wherein at least one energy carrier selected from the group consisting of fuel gas, coal and coal dust is admixed with said second oxygen jet to form an oxygen-fuel mixture.

3. The process according to claim 1, said second jet is blown at a volumetric rate that is selectively adjustable to achieve a desired carbon content for the pig iron.

4. The process according to claim 2, wherein said oxygen-fuel mixture is blown at a volumetric rate that is selectively adjustable to achieve a desired carbon content for the pig iron.

5. An apparatus for the smelting reduction of pre-reduced metal carriers in an emulsion of metal, slag and coke particles, comprising:

a smelting reduction reactor for containing said emulsion, said smelting reduction reactor comprising an upper portion defining an exhaust port;

a sealing tank, having an upper portion, for settling said emulsion to form an upper layer comprising slag and coke particles and a lower layer comprising metal, wherein at least a portion of said coke particles of the upper layer float on an upper portion of said upper layer;

a connection conduit connected to said reduction reactor and said settling tank for passing said emulsion from said reactor to said settling tank;

a first oxygen-blowing lance projecting into said settling tank for blowing a first jet comprising oxygen into said sealing tank, said lance comprising means for focusing said first jet to provide said first jet with sufficient momentum for penetrating through said upper layer comprising slag and coke particles to contact said lower layer comprising metal; and a second oxygen-blowing lance projecting into said upper portion of said settling tank for blowing a second jet comprising oxygen into said upper portion of said settling tank as a soft bushy flame having sufficient momentum to only pass through a portion of said upper layer so as to oxidize a portion of said floating coke particles and effect an increase in a volume of gas in said settling tank sufficient to cause a flow of gas from the sealing tank to the reduction reactor through said connection conduit and thereby drive the floating coke particles of the emulsion from the settling tank to the smelting reduction reactor opposite a direction of flow of the emulsion from the reduction reactor to the settling tank;

a lower portion of said connection conduit comprising a base attached to the settling tank, said base having a downwardly-sloping angle of inclination relative to the settling tank so as to cause the emulsion to flow from the reduction reactor into said settling tank through said connection conduit.

6. The apparatus according to claim 5, wherein said second lance has an annular opening defined at a downstream end thereof for producing said soft bushy flame.

7. The apparatus according to claim 6, further comprising an oxygen supply station and a fuel supply station, and means for coupling said oxygen supply station and said fuel supply station to said annular gap.

8. The apparatus according to claim 7, wherein said annular gap is arranged concentric to said first oxygen lance.

9. The apparatus according to claim 6, wherein said angle of inclination is between approximately 3° to approximately 12°.

* * * * *